United States Patent [19]

Galgana

[11] Patent Number: 4,927,394

[45] Date of Patent: May 22, 1990

[54] UNITARY BUOY

[76] Inventor: Thomas Galgana, 22 Gannett Rd., Quincy, Mass. 02169

[21] Appl. No.: 261,689

[22] Filed: Oct. 24, 1988

[51] Int. Cl.[5] ..... B63B 21/00

[52] U.S. Cl. ..... 441/1; 441/27; 441/28; 114/267

[58] Field of Search ..... 441/1, 21, 80, 23–28, 441/84

[56] References Cited

U.S. PATENT DOCUMENTS

| | | | |
|---|---|---|---|
| 3,829,919 | 8/1974 | Mathae | 441/28 |
| 3,916,467 | 11/1975 | Curd | 441/28 |
| 3,942,203 | 3/1976 | Perkins | 441/28 |

FOREIGN PATENT DOCUMENTS

| | | | |
|---|---|---|---|
| 714328 | 2/1980 | U.S.S.R. | 441/28 |

*Primary Examiner*—Joseph F. Peters, Jr.
*Assistant Examiner*—Clifford T. Bartz

[57] ABSTRACT

This invention is directed at a buoy which includes a body portion having a handle portion extending from one end and an engagement means extending from the other. The body portion of the buoy may be hollow and may be filled with flotation material. The handle portion may include teeth or annular ribs which are engagable by lock rings. The lock ring for engaging the teeth has an inwardly extending tab and the lock ring for engaging the annular ribs may have biased inner surfaces or inwardly extending tabs. The lock rings hold a second body portion in circumscribing relation to the handle portion.

1 Claim, 2 Drawing Sheets

UNITARY BUOY

BACKGROUND OF THE INVENTION

1. Field of the Invention

This invention relates to bouys and more specifically to hollow buoys.

SUMMARY OF THE INVENTION

The invention disclosed herein is directed at bouys having means of removably securing a second body portion to the handle. The buoy includes a body portion having a handle portion extending from one end and an engagement means extending from the other. The body portion of the buoy may be hollow and may be filled with flotation material. The handle portion may include teeth or annular ribs which are engageable by lock rings. The lock ring for engaging the teeth has an inwardly extending tab and the lock ring for engaging the annular ribs may have biased inner surfaces or inwardly extending tabs. The lock rings hold a second body portion in circumscribing relation to the handle portion.

BRIEF DESCRIPTION OF THE DRAWINGS

Further details are explained below with the help of the example(s) illustrated in the attached drawings in which.

DESCRIPTION OF THE PREFERRED EMBODIMENT

Figure 1:
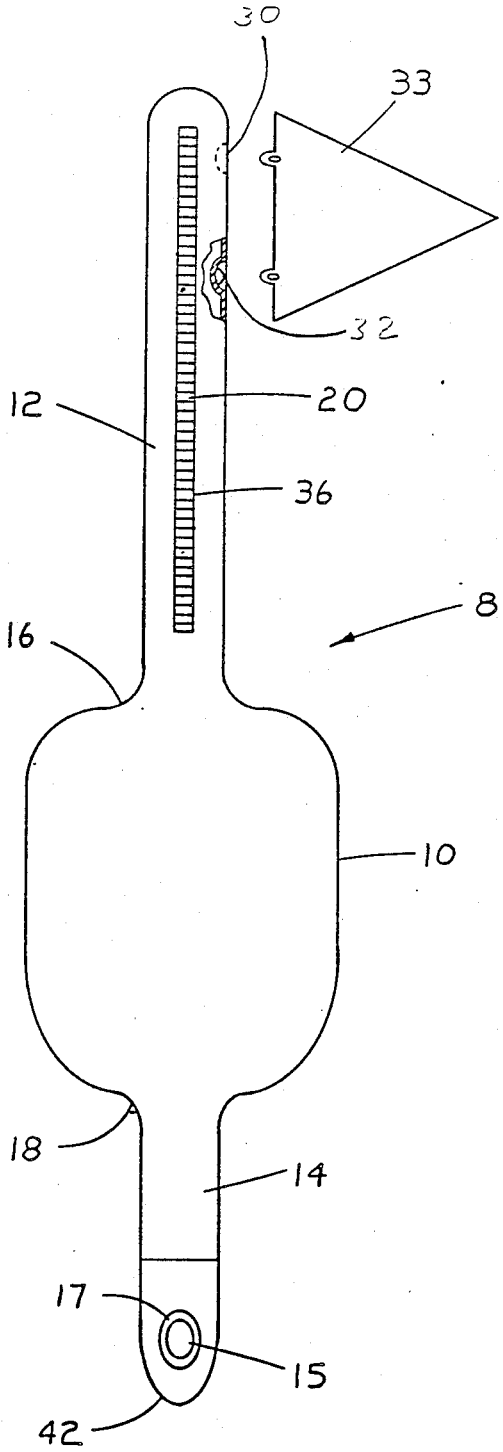
FIG. 1 is a front elevational view, partly broken broken away, of a buoy according to the present invention.

There is shown in FIG. 1, a buoy 8 comprising a body portion 10, a handle portion 12 and an engagement means 14. The buoy 8 which is unitary in structure may be formed of a plastic such as polyethylene or a similar material. The buoy 8 can be manufactured by blow molding or any other appropriate manufacturing process. The body portion 10 is tubular, bulbous in configuration, has a first end 16, a second end 18 and a longitudinal axis. The first end 16 has a curved shape and merges at the longitudinal axis into the handle portion 12 which extends in coaxial relationship with the longitudinal axis of the body portion 10. The second end 18 is bell shaped and merges at the longitudinal axis with the engagement means 14 which extends along a continuation of the longitudinal axis of the body portion 10. The body portion 10 can be filled with a flotation grade foam impregnated with aluminum chips to provide flotation, and allow radar tracking of the buoy while in the water.

Figure 3:
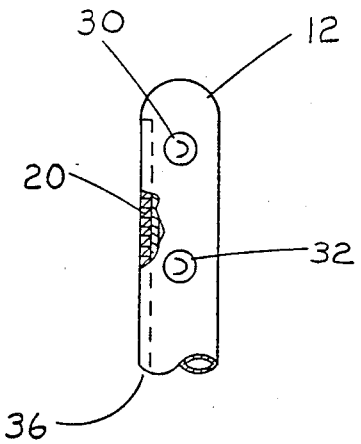
FIG. 3 is a transverse sectional view, partly broken broken away, of the handle of the buoy shown in FIG. 1.
Figure 2:
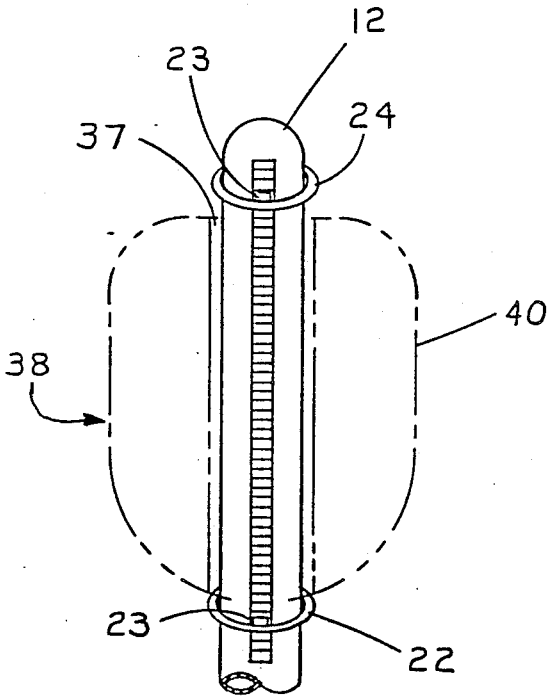
FIG. 2 is a transverse sectional view of the handle of the buoy shown in FIG. 1 with a second body portion shown in phantom and with lock rings engaged.

Handle portion 12 is hollow, has a tubular configuration and further comprises a series of teeth 20, a channel 36, an optional buoy assembly 38, as shown in FIG. 2, and a pair of recessed staples 30 and 32, as shown in FIG. 3. The teeth 20 which run longitudinally along one side of the handle 12, are positioned in the channel 36. The teeth 20 are at a 45 degree angle with the longitudinal axis, and their terminal ends are generally directed toward the body portion 10. The terminal ends of the teeth 20 are flush with the surface of the handle 12. The optional buoy assembly 38 may include locking means such as a first lock ring 22, a second lock ring 24, and a second body portion 40. The second body portion 40 may be formed of a plastic material such as foam. A through hole 37 extends along the entire longitudinal axis of the second body portion 40. The first and second lock rings 22 and 24 are formed of plastic and contain an inner tab 23. The tab 23 fits into the channel 36 and slides over the teeth 20. By passing the handle portion 12 up through the through hole 37 the second body portion 40 may be placed adjacent to lock ring 22. The lock ring 24 can then be engaged with the handle 12, in a manner similar to the engagement of the first lock ring 22, preventing the second body portion 40 from disengaging from the handle 12. If desired the second body portion 40 may abut the first body portion 10, a single locking means may be used to hold the second body portion 40 in place. The recessed staples 30 and 32 are positioned in right angle relationship with the channel 36. Staple 30 is in close proximity to the terminal end of the handle 12, and the staple 32 is in a spaced vertical relationship with staple 30 and closer to the body portion 10. A signal flag 33 is attached to the recessed staples 30 and 32 providing a means of easily identifying ownership of the buoy.

Engagement means 14 is solid, has a cylindrical configuration and includes a through hole 15, a grommet 17 and a tapered free terminal end 42. The through hole 15 is centered on the longitudinal axis of the engagement means 14, proximate the free terminal end 42. Grommet 17 is positioned within the through hole 15. The engagement means 14 provides a method of connecting the buoy 8 to a lobster trap, for instance, by passing the line of the trap through the hole 15 and tying it off.

Figure 5:
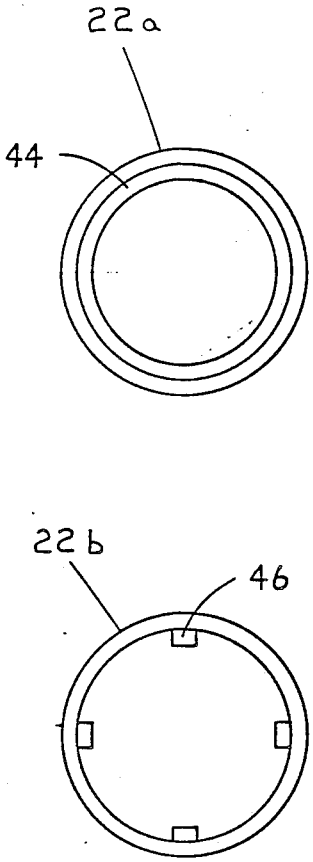
FIG. 5 is a top plan view of two types of lock ring for use with the buoy shown in FIG. 4.
Figure 4:
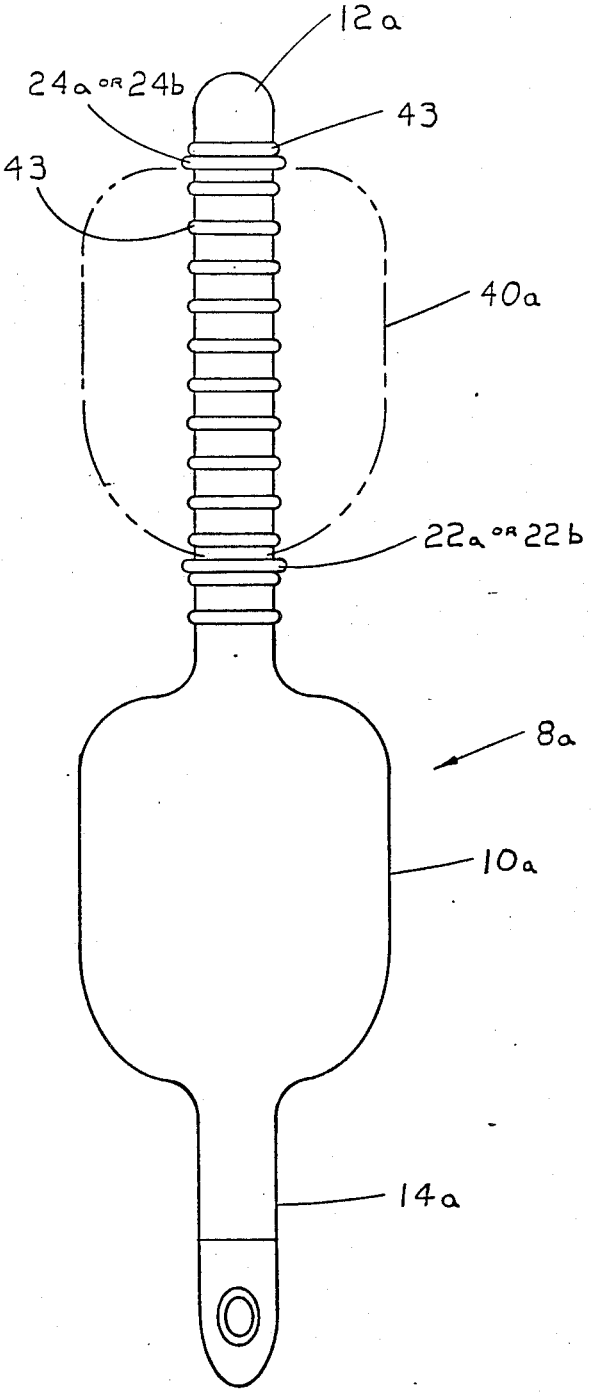
FIG. 4 is a front elevational view of a variation of the buoy shown in FIG. 1 with a second body portion shown in phantom and with lock rings engaged according to the present invention.

An alternate variation of the buoy 8 is shown in FIG. 4 as buoy 8A. In this variation handle portion 12A is similar in configuration to the handle portion 12. A series of circular ribs 43 replace the teeth 20 and channel 36. In one variation, the ribs 43 encircle the outer surface of handle portion 12A similar to a donut shape. The ribs 43 are in spaced relation to each other along the longitudinal axis of the handle 12A. In an alternate embodiment, the ribs 43 extend half way around the handle in an arc shape. Tab 23 on lock rings 22 and 24 will be replaced by a biased surface 44 or a set of tabs 46. Shown in FIG. 5 is the alternate lock ring 22A with the biased inner surface 44 and an alternate lock ring 22B with the tabs 46. If the external diameter of the handle 12A is $\frac{7}{8}$ of an inch than the inner diameter of the lock rings will preferably be $\frac{7}{8}$ of an inch. These diameters allow the biased surface 42 or the tabs 46 to engage the ribs 43 providing support for the body portion 40A and stopping the body portion 40A from sliding off handle 12A. To enable movement over the ribs the biased surface 44 and the tabs 46 flex. The remaining portions of buoy 8A remain identical to buoy 8.

What I claim is:

1. A unitary buoy, comprising a body portion and a handle portion, the body portion including a first end, the handle portion extending from the first end and including a terminal end and a shaft and having a series of longitudinal teeth set in a channel, the shaft being hollow.

* * * * *